United States Patent [19]

Schwan et al.

[11] Patent Number: 4,974,447

[45] Date of Patent: Dec. 4, 1990

[54] METHOD AND APPARATUS FOR THE SHAPING TREATMENT OF HAIR WOUND ONTO ROLLERS, INCLUDING HUMAN HAIR

[75] Inventors: Annette Schwan, Darmstadt; Rupert Zang, Grossostheim, both of Fed. Rep. of Germany

[73] Assignee: Wella Aktiengesellschaft, Darmstadt, Fed. Rep. of Germany

[21] Appl. No.: 289,367

[22] Filed: Dec. 22, 1988

[30] Foreign Application Priority Data

Dec. 23, 1987 [DE] Fed. Rep. of Germany ..... 3743850

[51] Int. Cl.[5] ..... G01L 5/04

[52] U.S. Cl. ..... 73/160; 132/223

[58] Field of Search ..... 73/160

[56] References Cited

U.S. PATENT DOCUMENTS

| | | | |
|---|---|---|---|
| 2,496,206 | 1/1950 | Grigsby | 73/160 |
| 4,801,922 | 1/1989 | Worrell et al. | 340/573 X |
| 4,845,983 | 7/1989 | Heusser | 73/160 |

FOREIGN PATENT DOCUMENTS

| | | |
|---|---|---|
| 61-42822 | 9/1986 | Japan . |
| 62-58169 | 3/1987 | Japan . |

*Primary Examiner*—Daniel M. Yasich

*Attorney, Agent, or Firm*—Michael J. Striker

[57] ABSTRACT

Method and apparatus are disclosed for the optimal hair shaping treatment of hair coiled onto rollers, e.g. human hair, whereby the deformations of a roller body resulting during a hair shaping treatment are detected and introduced as deformation measurement values to an arrangement for developing the measured values, which compares at least one pre-determined characteristic measurement value corresponding to an optimal running of the treatment with the measured values and then indicates a concordance.

16 Claims, 4 Drawing Sheets

Fig. 4
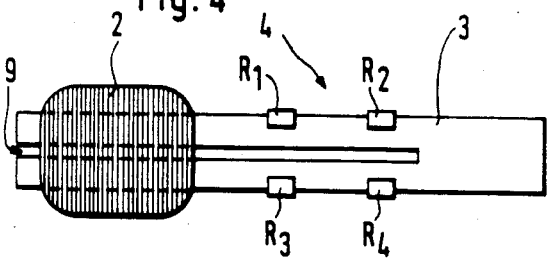
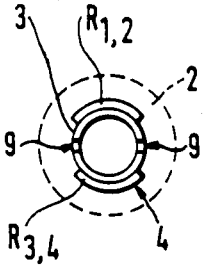
Fig. 5
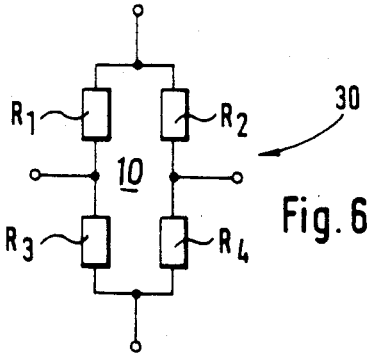
Fig. 6
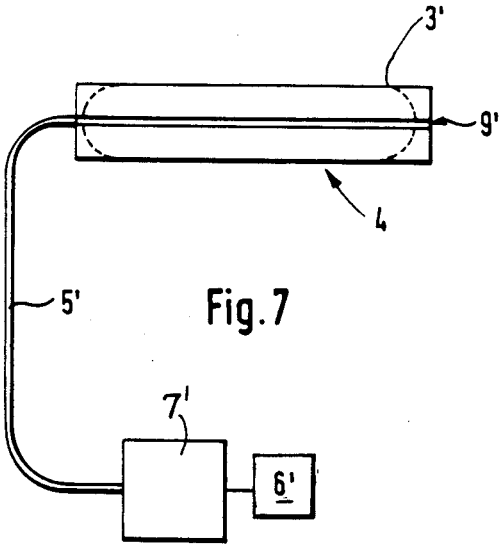
Fig. 7
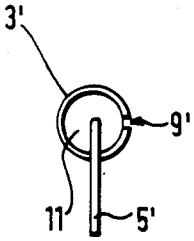
Fig. 8

METHOD AND APPARATUS FOR THE SHAPING TREATMENT OF HAIR WOUND ONTO ROLLERS, INCLUDING HUMAN HAIR

BACKGROUND OF THE INVENTION

The invention concerns a method for the hair shaping treatment of hair coiled onto rollers, e.g. human hair, in which the extent of the deformation of the hair is measured and compared with pre-determined, characteristic measurement values, as well as an apparatus for the performance of this method.

A shaping, e.g. permanent, of human hair refers to two processes:

a two-stage chemical process, the reduction and then oxidation of cysteine portions in the hair, and a physical process, the shaping.

Whether or not both processes can run completely independent of each other, they occur partially simultaneously and also partially successively during a permanent shaping procedure. Accordingly, the permanent shaping process is difficult to analyze.

With regard to the chemical operations during the so-called "permanent", these basically derive from the use of thioglycolic acid or thioglycolate as permanent shaping means. It is thus known that a hair can be permanently deformed when a part of the chemical network which is present in the hair is broken, by means of a reducing agent, and the hair thereby put into a softer state, is shaped onto a roller means. When the network junctions in the hair are closed once again through the process of oxidation, the hair maintains itself in the shape of the roller.

The causal connection between the reducing capacity of a permanent shaping solution and the resulting softening of the hair is known from tests of the elongation behavior of hair which is stretched in the presence of permanent shaping means. It is clear that also the wave results in the hair and the wave stability of the produced hair locks are a direct function of the reducing capacity of the shaping solution.

It is known from the literature and the general practice of hair-styling that a problem is presented by the great differences in the deformability of individual scalp hairs, on account of the known variability of the hair. Although rough guiding principles exist, whereby through selection of rollers, choice of preparation and penetration periods, a good permanent shaping result can be obtained, it is nevertheless compulsory during the permanent shaping procedure to unroll a so-called test roller, several times, in order to determine, by means of the degree of shape acceptance, whether the penetration period should be extended or terminated. Since the determination of the penetration period lies within the judgment of the hair-stylist and, moreover, the testing of the hair-do is done generally at intervals from 3 to 10 minutes, it frequently occurs that the optimal period of shaping is not correctly recognized and is either exceeded or not reached. Accordingly, one obtains a poor shaping and injured hair. In addition, this technique requires a great deal of attention from the hair-stylist.

The problem has been known for quite a long time and has indeed been the subject of frequent investigations. The thereby resulting techniques and suggestions for controlling the permanent shaping process are based upon an attempt to detect the chemical operations in the hair.

In Japanese Pat. No. JP-A-62-58 169 it is suggested to measure the hydrogen sulfide gas produced during the permanent shaping procedure, by means of an electrical device. The time of greatest gas development is supposed to clearly indicate the endpoint for the shaping process.

According to Japanese Pat. No. JP-A-60-42822, an electrical device is employed to measure the diminishing redox potential of the reducing agent during the shaping procedure. It is falsely taken for granted therewith, that these measurements correlate directly with the shaping results in the hair. Measurements of the mentioned type depend only upon formulation parameters of the employed shaping composition, and do not take into account the individual differences of the treated hair. However, this is unconditionally necessary, to take into account the individual differences of the treated hair, in order to obtain a good shaping result.

The applicants herein have also determined that the shaping results of a permanent shaping treatment are predominantly determined by the softening and hardening behavior of the individual hairs, and not by the attainment of a determined degree of reduction in the hair. Thus, there are hair types which require a relatively strong reduction in order to attain a softening necessary for the deformation, and other hair types which must be reduced only slightly, in order to obtain the same state of softening.

Devices which thus detect the chemical operations in the hair are less suitable for detection of the permanent shaping results in the hair.

Proceeding from the assumption that the measurement of physical hair parameters is suitable for determining in advance what the shaping results will be after a permanent shaping treatment, leads in Japanese Pat. No. JP-B-62-29744 to the suggestion for a device which measures only the bending movement of a semi-circular shaped, bound bundle of hair. It enables one to determine, in laboratory tests, the softening power of permanent shaping means, and the comparison of different such means. However, the different hair structure of each human, and the associated variations in the strength of reaction, is not considered. The device is not useful in the practice of hair dressing.

It was first proven recently by Wortmann and Souren (Extensional properties of human hair and permanent waving, Journal of the Society of Cosmetic Chemistry, No. 38, Mar./ Apr. 1987, pages 125–140) that softening measurements in laboratory tests of stretched hair permit no precise pre-determination of the stability (so-called "hold") of hair locks which have been shaped upon a roller.

A device is known from U.S. Pat. No. 2,496,206 which indicates, allegedly, the optimal time point for the end of the treatment of permanently shaped hair. For this, several hairs serving as reference must be removed from the hair, which are rolled onto a measurement cell. The measurement cell serves as a pressure sensor, and is composed of a thin-walled, elastic material. It is a component of a hydraulic system. The hydraulic fluid is stream-flowed and, depending upon the quality of the hair, manually brought to a determined height. An overflow of the hydraulic fluid, resulting from a contraction of the hair, is electrically determined and then signalled, as supposedly being the optimal point in time, whereby the hair on the measuring cell is kept at the same temperature as the hair on the head. A significant disadvantage of such a device is the high degree of inaccuracy caused by the comparison temperature in the measuring cell, to be obtained without precision by means of various physical characteristics between the measuring cell and the roller bodies in the hair, and by means of a manual pre-adjustment of the height of the hydraulic fluid. A further disadvantage is seen in that the hairs serving for the measurement must be separated from the head.

SUMMARY OF THE INVENTION

It is therefore an object according to the present invention to make available a method which avoids the above-mentioned disadvantages, and thereby make possible an optimal running of the hair shaping treatment so that there will result hair which, particularly with a permanent hair shaping treatment, is uninjured and waved to the greatest extent possible.

It is a further object according to the present invention to make available an arrangement of apparatus for the performance of this method.

These and other objectives are attained according to the present invention by a method for the hair shaping treatment of hair, e.g. human hair, which is coiled upon a roller, thereby characterized in that the shaping, i.e. deformation, of the coiling element means resulting during a hair shaping treatment is determined and introduced as shaping data to a data processing arrangement which compares at least one characteristic measurement value corresponding to an optimal running of the treatment, with the measured values, and indicates a concordance.

According to a preferred embodiment, the characteristic measurement value is given by segment $t_0$–$t_3$, or the segment ending at $t_5$, of the shaping means curve represented in FIG. 3, infra.

The recited objectives are attained according to the present invention by an apparatus for the performance of the method for the hair shaping treatment of hair which is coiled onto rollers, characterized in that the coiling element means are provided with an arrangement for grasping the shaping of the roller, the arrangement is connected with an arrangement for the development of measurement values, that the arrangement for the development of measurement values is connected with an arrangement for the working-up of measurement values, that the arrangement for the working-up of measurement values is provided with at least one characteristic measurement value register, whereby the arrangement for the working-up of measurement values compares the registered characteristic measurement value with the measured values and indicates a concordance.

The optimization/measurement method is performed in practice according to the present invention on hair which is bent onto a roller, since the waving operation is a combination from a complex of operational parts, such as chemical hair reduction, bending of the hair, hair softening, hair contraction and hair relaxation. One can thereby observe the physical operations taking place in the hair during a shaping treatment under practical conditions.

The hair can be fixed in place in customary manner, e.g. by means of a rubber gasket. At the start of the wave treatment, the waving means, e.g. water, preferably however a reducing agent such as e.g. thioglycolic acid, a salt or ester of thioglycolic acid, cysteine or sulfite-containing waving means, is applied onto the hair. After completion of the optimal penetration period, which runs in each case from between 5 and 60 minutes, depending upon the quality of the hair and the permanent shaping means, as well as the employment temperature, and is indicated by means of the arrangement according to the present invention, the hair is rinsed with water in customary manner. (Instead of water, aqueous preparations of conditioning agents can also be used for rinsing out the shaping means.)

After briefly wiping off excess water, using vacuum means or a hand towel, the hair is oxidatively aftertreated in the customary way with a fixing agent, such as e.g. an aqueous solution of hydrogen peroxide or potassium- or sodium bromate, which concludes the waving operation. The hair can be uncoiled from the rollers for drying and hair-do formation, or preferably even dried while still on the rollers.

The method is set up so that the operations are observed not as was formerly customary, e.g. with permanent shaping methods, on stretched, pre-elongated hair, but rather in the bent, rolled state, as it is the case in practice. One can with the present method also employ hair bundles of differing weight and defined amounts of waving means or reducing agent, which was not possible with the previously known individual fiber measuring techniques in stretch testing devices. With the latter-mentioned techniques, operationally expensive hair diameter measurement determinations had to be made in each case, which are dispensed with.

The present method is performed with large amounts of solvent, which is completely foreign to the practice. All previous physical investigations of the waving process possess only completely limited evidentiary value.

The method according to the present invention is advantageous in that even with the most widely different types of hair, a lock can be obtained displaying stability and "hold" which can be pre-determined for the most different hair shaping treatment means and even various degrees of waving. Accordingly the excellence of a permanent shaping can be placed in direct relation to the previously observed waving operation in the same hair. This was not previously possible, since always new hair material had to be employed for the elaboration of correlations between the softening/hardening characteristics of the hair, its waving behaviour and its degree of injury. In view of the large number of hair types, this leads to extensive testing, which is now dispensed with The present method is thus a so-called "index method", employable as such also directly in vivo on the heads of human test subjects. The present method takes over the objective of a reference roller (which customary roller displays the same shaping characteristics), which is placed in the hair of the test subjects/customers during the permanent shaping operation. It is not, however, unrolled—as was previously customary—for examination of the progress of the waving operation. Instead, the maximum/optimal softening state of the hair is indicated by an optical or acoustical signal, whereby then a termination of the waving operation can ensue. This occurs preferably by means of rinsing the hair in water, aqueous intermediate treatment means, or by the application of an oxidative fixing agent. The progress of the fixing operation and the hardening operation of the hair can likewise be indicated, if need be, by means of the reference roller.

Indeed according to expediency, and considering the cost factors, indication of the deformation of the roller bodies can be effected through employment of a chosen combination of mechanical, optical, acoustic, electrical, magnetic, pneumatic or hydraulic deformation-registering techniques.

The optimal course of treatment, and thereby the typical shaping characteristics, are based essentially—as can be determined by the invention—upon the swelling- and contraction behaviour, as well as the plastic range of the hair. The latter is a characteristic of the subject's individual hair type. Upon contact of the waving agent with the hair, it begins to swell and to contract slightly during the waving process. By means of the pressure of swelling, radial forces acting on the roller body are incurred. Since the hair is simultaneously chemically reduced, and thereby softened, the radially acting forces attain a maximum during the period in which the hair enters into its plastic range. This is indicated by means of an abatement of the radial forces on the roller body. Advantageously, a deformation of the hair far beyond the plastic range should be avoided, since otherwise irreversible structural changes take place in the hair. The typical deformation characteristic of the roller bodies is characterized, moreover, in that the hair swells anew in the rinsing step connected with the waving agent treatment. This is indicated by means of increasing radial forces The completion of the entire waving process by means of the associated treatment with oxidative fixing agent effects not only the reversion of the hair back into its natural chemical state, but also a swelling. This is detected on the roller body by means of an abatement of the radial forces. Since the "hold" of a hair shaping, e.g. with a permanent wave, is dependent upon the degree of re-oxidation and upon a minimization of the residual swelling of the hair, the time for the fixing operation which is thereby required can be indicated with the method according to the present invention.

In particularly advantageous manner, the method for automatic detection according to the present invention can also employ several deformation characteristics, in which case deformation measurement values are formed across a deformation sensor, which are introduced to an arrangement for the working-up of measurement values for comparison of at least one predetermined characteristic measurement value with the measured values and indication of a concordance. In this manner, one or more treatment period time reference points can be detected, each after the attainment of a pre-determined characteristic measurement value.

When such characteristic measurement values are entered into the arrangement for the working-up of measurement values, corresponding in each case to an optimal running of the treatment, depending upon the treatment means employed, the beautician is automatically informed or signalled as to just when a treatment step (e.g. the waving agent treatment) is optimally completed. Depending upon the pre-determined characteristic measurement value, the degree of treatment can also be pre-determined when, for example, a determined degree of excessive or deficient waving is desired to be obtained.

The method according to the present invention is suitable for the most various hair shaping techniques, e.g. for a permanent hair shaping or even a water waving.

The arrangement for the performance of the method according to the present invention includes means for detecting the shape of the roller, means for developing measurement values, means for working-up the developed measurement values—provided with at least one characteristic measurement value register—whereby a comparison of measured values with pre-determined characteristic measurement value(s) is performed, and an agreement is indicated.

In order for the apparatus to be able to detect the physical operations occurring during a hair shaping treatment even into the plastic range of the hair, the roller bodies have to be able to reversibly detect the deformations, e.g. by means of a pressure spring. A roller body provided with spring action can be accomplished for example, by shaping the roller as a hollow cylinder provided with at least one slit.

Indeed depending upon the deformation detection technique, (mechanical, optical, acoustic, electrical, magnetic, pneumatic or hydraulic,) an appropriate sensor can be arranged in the roller body.

The roller body is provided with an appropriate means, such as e.g. in the form of axial projections for the connection of rubber gaskets, to hold the coiled hair in place.

In order to realize an optimal treatment over the entire head of hair, the hair rollers (up to about 50 units in practice) display the same shaping characteristics as the roller body according to the present invention, provided with the arrangement for detection of the deformation. In this manner the roller body functions as a reference roller.

Advantageously, an integrated roller body/measurement value working-up arrangement is provided, whereby through utilization for example of an integrated signal generator or display, employing for example an acoustic signal, a one-piece arrangement is available for performance of the method according to the present invention. This is particularly suitable for a reference roller in practice. Alternatively, the roller body can even be provided with a signal- or measurement value lead to a separate display or a separate measurement value working-up arrangement.

By means of a transmitter integrated into the roller body, the measurement values can advantageously be conveyed wireless, for instance to a measurement value working-up working-up arrangement with an optical and acoustic display.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 4 is a schematic representation of one embodiment of a roller body according to the present invention;

FIG. 5 is a side-view represenation of the roller body according to FIG. 4;

FIG. 6 is a schematic representation of an elongation measurement circuit employed as a deformation sensor in the embodiment of FIG. 4;

FIG. 7 is a schematic representation of a second embodiment of a roller body according to the invention;

FIG. 8 is a side-view representation of the roller body in FIG. 7;

DESCRIPTION OF THE PREFERRED EMBODIMENTS

Figure 1:
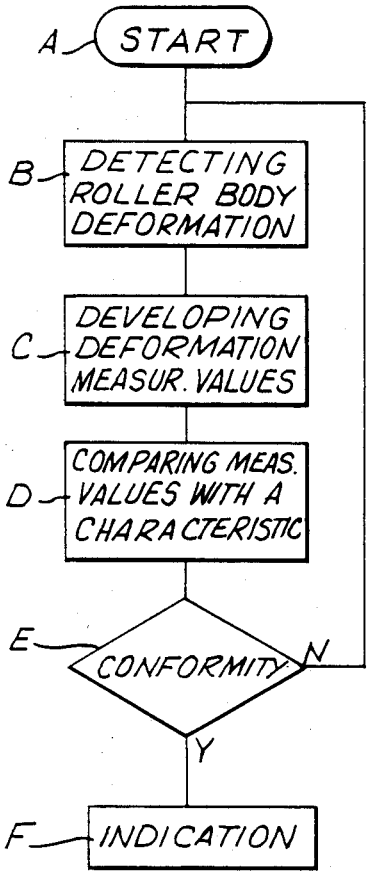
FIG. 1 is a flow-chart representation of the method according to the invention for the shaping treatment of hair wound onto rollers.

FIG. 1 sets forth a flow-chart of the principal method steps. After the hair is coiled onto a roller 2 (see FIG. 2, infra) and mechanically fixed in place, the hair shaping process begins (starts). In first step B, the deformation of the roller body is detected. In a second step C, the deformation measurement values are worked-up and then compared in steps D and E with a pre-determined characteristic measurement value. In a step F, conformity to the characteristic measurement value is indicated.

By means of the provided characteristic measurement value, which corresponds to an optimal running of the treatment, the optimal time points for the treatment can be indicated, e.g. the ending of the actual hair deformation and the subsequent fixing process.

Figure 2:
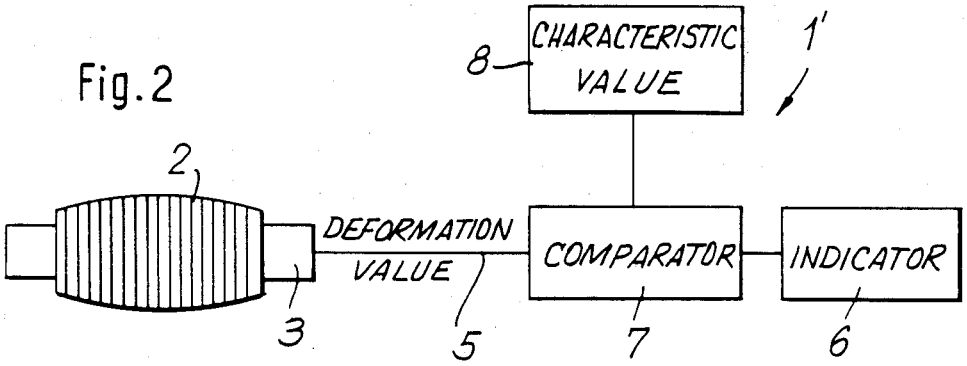
FIG. 2 is a schematic representation of the principal apparatus for performance of the method according to the present invention.

In FIG. 2 is represented a principal arrangement 1 for performance of the method according to the present invention. After rolling of the hair 2 onto a roller 3 and fixing the same thereon, the deformations of roller 3 resulting during the hair shaping process are detected by a nonillustrated sensor. The detected deformation value can be introduced via line 5 to a measurement value development and comparator arrangement 7, where it is compared with the characteristic measurement value delivered by means of unit 8. A conformity of the given characteristic with the measured values is indicated by means of indicator 6, optically or acoustically.

Figure 3:
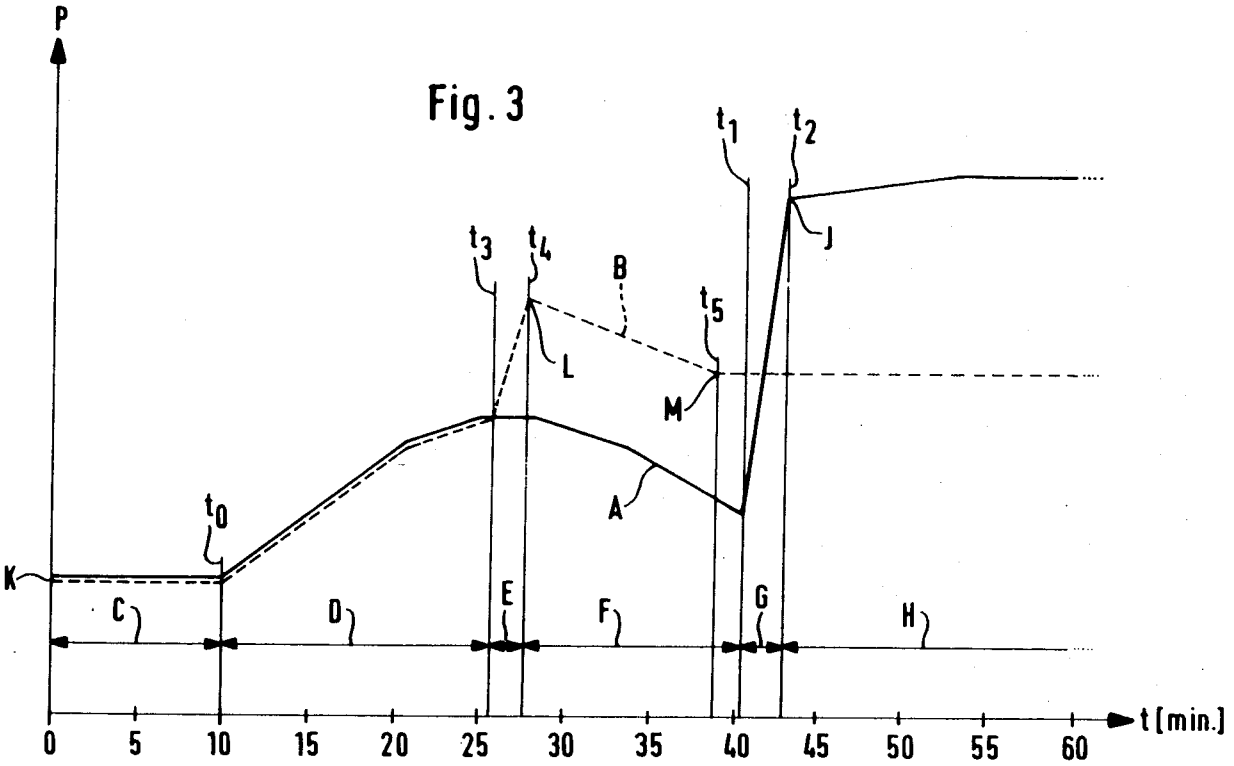
FIG. 3 is a time diagram of roller deformation in a prior art method and in the method according to the invention.

FIG. 3 presents the time t course of the deformation p of the roller, e.g. roller 3, 3', 3'', 3''' as in FIGS. 4 through 12, during a permanent hair shaping process. The curve section A (continuous line) represents a treatment sequence with over-waving, i.e. excess duration of the deformation process; curve section B (dashed line), in contrast, is for an optimal treatment sequence, whereupon resulting in a practically injury-free, permanently waved hair.

The following paragraph describes more detailed the meaning behind curve segment A. The given time values are to be considered as only rough, approximate values. After the hair 2 is coiled onto roller 3 (segment C), a stationary deformation is present at roller 3 (deformation p=K). The represented time period of 10 minutes for segment C is valid as a total period for the coiling onto further roller bodies (about 40 pieces) for a complete head of hair treatment. At time $t=t_o$ is the start of the hair shaping process with a waving agent. Thereby is the roller body 3, increasingly deformed in the range curve segment D. In range E which follows, the maximum is attained In the further course of the hair shaping process in range F, the body 3 is reduced in its deformation. The end of the treatment with waving agent at time $t=t_1$ is determined by a water rinsing of the hair 2. The quality of the wave of hair 2 is determined in each instance according to the length of treatment $t_1-t_o$. The time reference point $t_1$ was previously determined by means of unrolling—generally several times—of a particular curler and by manual testing of the tension of the lock. This manual technique is operationally expensive and requires great attention, since it is a testing for the particular feel of a determined quality of wave, and the testing itself is very subjective. For this reason, the quality of wave from case to case—also on account of differences in hair structure—can turn out to be non-uniform. Too long a waving agent treatment period $t_1-t_0$ (range D - E - F) leads to an over-waving and injury to the hair. During the water rinsing operation in range G the roller body 3 is greatly deformed increasingly, up to a maximum point J. The fixing treatment in range H commences at time point $t_2$. The deformation then increases slightly and then remains more or less constant.

The curve B is identical in the ranges C—D. From $t=t_3$ there occurs in range E a water rinsing which is finished at time point $t=t_4$. Thereupon starts the fixing treatment, which proceeds through ranges F - G - H.

It has now been determined by means of the present invention that the optimal time point $t=t_3$ for ending the waving agent treatment lies approximately in range E. The characteristic for this is that the curve range B assumes a maximum value (turning point) in range E. This characteristic measurement value (e.g. the first turning point or the attainment of a determined slope between two timepoint measurements) is stored in the unit 8 and applied into the arrangement for the development and comparison of measurement values and is then compared with the developed deformation measured values. Upon the measured value has reached the characteristic value, this is appropriately indicated. In each case depending upon the desired degree of waving, an appropriate characteristic measurement value can be pre-determined, corresponding to a desired window-like or intermittent detection of measurement value, which can also be supplemented by a pre-determined time frame, for the purpose of certainty of measurement. The water rinsing starts at time $t=t_3$, ending at time $t=t_4$. Accordingly, it is clear that the maximum rise in deformation occuring therewith (i.e. point L) is substantially less than the corresponding rise in curve A at point J. The fixing process is joined directly after the water rinsing Surprisingly the curve then falls steadily until time $t=t_5$ at point M where the rate of deformation is minimal. From this it is clear that from point L during the fixing process the force of deformation diminishes and remains in equilibrium down to point M. As could be determined, the time $t=t_5$ at point M of the charactistic curve represents the optimal ending of the fixing process. Accordingly, the corresponding characteristic measurement value can be so pre-determined, that the optimum lies in the attainment of a curve plateau (M). Then the water rinsing can start.

It is clear from a comparison of both curves A and B that through too long a waving agent treatment, according to curve run A, the hair is put into a state wherein it strongly swells upon contact with water, whereby the hair structure is permanently injured. In the other case according to curve run B, the behaviour is such that the hair swells substantially less, so that the hair structure remains practically uninjured.

A first operational example of a roller body 3 is set forth in FIG. 4. The roller body 3 is in the shape of a hollow cylinder, e.g. of aluminum, and displays an arrangement 4 for the detection of the roller body deformation. The arrangement 4 includes two one-sided slits 9 lying diametrically opposite and running from a point somewhere between both ends of the roller body to one end of the roller body, whereby a spring action of the body 3 is attained, and a deformation sensor 30 (FIG. 6) consisting of an elongation resistance measurement circuit R1–R4 disposed on the body 3 in the range of the interior end of the slit 9. By means of the lever action, the deformations issuing from the coiled hair strands are amplified on the body 3 in the range of the measuring strips R1–R4 and deformation values can be precisely detected by means of the Wheatstone bridge circuit 10 (FIG. 6).

An axial view of the roller body 3 on the side of the open slits 9 is represented in FIG. 5, whereby the rolled-up hair strands 2 are only suggested by dotted line.

A second operational example of a roller body 3' with employment of a hydraulic measurement value detection system 4' is represented in FIG. 7. The body 3' is formed as a hollow cylinder and provided with one continuous axial slit across the entire length, i.e. slit 9', which serves, as do the slits 9 of FIG. 4, for reversible deformation of the body 3'. Disposed in the hollow cavity of roller body 3' is a liquid container 11 serving as a hydraulic sensor 31, which is so formed that the deformations of body 3' brought on by the hair strands cause a corresponding change in the volume of container 11 and are conveyed across a capillary conduit 5' to a measurement value development and comparison arrangement 7' including a converter for formation of electrical values. The indicator 6' can be so formed that also instantaneous values or a time slope is indicated.

For better understanding, an axial view of the body 3' is represented in FIG. 8. Instead of the hydraulic measurement value detection, a corresponding pneumatic detection can be provided.

Figure 9:
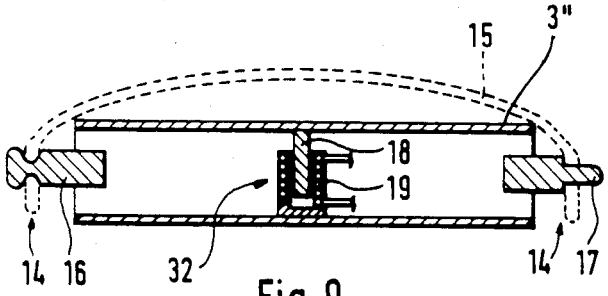
FIG. 9 is a schematic representation of a third embodiment of a roller body according to the invention.
Figure 10:
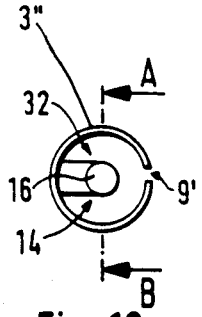
FIG. 10 is a side-view representation of the roller body in FIG. 9.

FIG. 9 sets forth in the section A-B from FIG. 10, as a third operational example, a roller body 3'' in the interior of which is disposed an electromagnetic sensor 32 including a magnet 18 lying diametrically opposite an electro-coil 19, so that changes in the deformation of body 3'' effect changes in inductance which are detected frequency-wise by an electrical resonant circuit. An arrangement 14 serves to hold in place the coiled hair by means of an elastic strap 15, with axial projections 16, 17 provided for the fixing of the strap.

Figure 11:
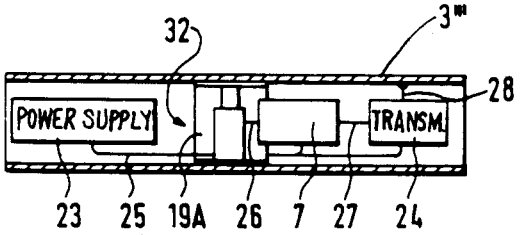
FIG. 11 is a schematic representation of a roller body with integrated battery, arrangement for the working-up and comparison of measurement values and wireless transmitter.
Figure 12:
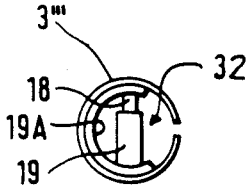
FIG. 12 is a side-view representation of the roller body according to FIG. 11.

A roller body 3''' with an integrated power supply 23, measurement value development and comparison arrangement 7 and wireless transmitter 24 is represented in FIG. 11. The power supply or battery 23 is connected with the arrangement 7 and the transmitter 24 by means of a conduit 25. In addition, the sensor 32 is is connected via conduit 26 with the arrangement 7. The latter is so formed as to detect also the change in deformation measurement values of sensor 32. Transmitter 24 for the sending of a signal is controlled via conduit 27. Antenna conduit 28 is connected with the metal roller body 3''' acting as an antenna. The magnet 18 and the coil 19 can be combined as a structural unit within a cylinder-like housing piece 19A, for the purpose of simplification of the assembly. Through suitable sealing measures, the sensor 32 and the elements 7, 23, and 24 are made fluid-tight.

It will be understood that each of the elements described above, or two or more together, may also find a useful application in other types of hair treatments differing from the types described above.

While the invention has been illustrated and described as embodied in a method and apparatus for the shaping treatment of hair wound onto rollers, including human hair, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. Method for the hair shaping treatment of hair coiled onto a roller particularly human hair, comprising determining the deformation of the roller resulting during a hair shaping treatment and developing a determined deformation as measurement data, and comparing at least one characteristic measurement value corresponding to an optimal running of the treatment with the measurement data and indicating a time point of conformity of the measurement data with the characteristic measurement value.

2. The method according to claim 4, employing as a characteristic measurement value for the end of the fixing period a minimum rate of deformation of the roller during the fixing period.

3. The method according to claim 1, wherein the hair shaping treatment includes a waving period, a rinsing period and a fixing period, and employing as characteristic measurement value for the end of the waving period a maximum deformation value of the roller during the waving period.

4. The method according to claim 3, employing as a characteristic measurement value for the end of the rinsing period a maximum deformation value of the roller during the rinsing period.

5. Apparatus for performance of the method for the hair shaping treatment of hair which is coiled onto coiling element means, comprising means for detecting deformation of said coiling element means, said means for detecting deformation of said coiling element means are provided on said coiling element means, means for the development of the detected deformation into measurement values, means for storing characteristic measurement values corresponding to an optional running of the hair shaping treatment, said storing means are connected with said means for the development of measurement values and said development means compares at least one of said characteristic measurement values with said measurement values; and means for indicating time point of conformity of the compared values.

6. The apparatus according to claim 5, further comprising deformation-detecting sensor means disposed on said coiling element means.

7. The apparatus according to claim 5, said coiling element means are formed so as to provide reversible registering of said deformation.

8. The apparatus according to claim 7, wherein said coiling element means are formed at least partially with spring action.

9. The apparatus according to claim 8, wherein said coiling element means are formed as a hollow cylinder defining at least one axial slit.

10. The apparatus according to claim 5, wherein said coiling element means includes a plurality of rollers.

11. The apparatus according to claim 10, wherein said rollers display the same deformation characteristics.

12. The apparatus according to claim 5, further comprising means for holding the hair in place on said coiling element means.

13. The apparatus according to claim 5, wherein said means for the development of measurement values are integrated into said coiling element means.

14. The apparatus according to claim 13, further comprising a transmitter means integrated into said coiling element means for signalling said conformity.

15. The apparatus according to claim 13, further comprising a power supply means integrated into said coiling element means.

16. The apparatus according to claim 15, further comprising a transmitter means integrated into said coiling element means for signalling said concordance.

* * * * *